US010801285B2

(12) United States Patent
Wubben et al.

(10) Patent No.: US 10,801,285 B2
(45) Date of Patent: Oct. 13, 2020

(54) RETRIEVABLE SELF-ENERGIZING TOP ANCHOR TOOL

(71) Applicant: SHELL OIL COMPANY, Houston, TX (US)

(72) Inventors: Antonius Leonardus Maria Wubben, Amsterdam (NL); Tino Walter Van Der Zee, Joure (NL); Djurre Hans Zijsling, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/471,060

(22) PCT Filed: Dec. 19, 2017

(86) PCT No.: PCT/EP2017/083443

§ 371 (c)(1),
(2) Date: Jun. 19, 2019

(87) PCT Pub. No.: WO2018/122029

PCT Pub. Date: Jul. 5, 2018

(65) Prior Publication Data

US 2019/0323306 A1 Oct. 24, 2019

(30) Foreign Application Priority Data

Dec. 22, 2016 (EP) ..... 16206380

(51) Int. Cl.
*E21B 23/01* (2006.01)
*E21B 33/129* (2006.01)
*E21B 43/10* (2006.01)

(52) U.S. Cl.
CPC ..... *E21B 23/01* (2013.01); *E21B 33/129* (2013.01); *E21B 43/105* (2013.01)

(58) Field of Classification Search
CPC ..... E21B 23/01; E21B 33/129
See application file for complete search history.

(56) References Cited

U.S. PATENT DOCUMENTS 1,919,853 A * 7/1933 Mack ..... E21B 33/129 166/134
1,971,514 A * 8/1934 Stone ..... E21B 33/129 166/124

(Continued)

FOREIGN PATENT DOCUMENTS

CN 1575372 A 2/2005
CN 201027511 Y 2/2008

(Continued)

OTHER PUBLICATIONS

International Search Report and Written Opinion received for PCT Patent Application No. PCT/EP2017/083443 dated May 24, 2018, 11 pages.

(Continued)

*Primary Examiner* — Cathleen R Hutchins

(57) ABSTRACT

A retrievable self-energizing top anchor tool with a central energizing mandrel disposed around a central tool bore and a set of anchor segments distributed around a circumference of the central energizing mandrel, each having one or more wedge surfaces facing toward the central tool bore and corresponding to and engaging inclined surfaces of the central energizing mandrel. The tool is releasable by relative upward movement of a release sub against a release sub stop arranged within the central tool bore. A release mechanism houses one or more pre-loaded release spring members locked with a release locking mechanism. When unlocked the release spring members exert a retracting bias force on the central energizing mandrel in downward direction along the longitudinal axis relative to the set of anchor segments. This downward movement of the central energizing mandrel (Continued)

causes a radially inward movement of the set of anchor segments.

15 Claims, 2 Drawing Sheets

(56) References Cited

U.S. PATENT DOCUMENTS

| | | | | |
|---|---|---|---|---|
| 2,117,535 | A | 5/1938 | Baker et al. | |
| 2,467,860 | A | 4/1949 | Saurenman | |
| 2,765,855 | A | 10/1956 | Reed | |
| 3,036,640 | A | 5/1962 | Clark | |
| 3,045,757 | A | 7/1962 | Conrad | |
| 3,045,758 | A | 7/1962 | Muse | |
| 3,162,245 | A | 12/1964 | Howard et al. | |
| 3,179,168 | A | 4/1965 | Vincent | |
| 3,358,760 | A | 12/1967 | Blagg | |
| 3,374,839 | A | 3/1968 | Lebourg | |
| 4,648,446 | A | 3/1987 | Fore et al. | |
| 4,750,559 | A | 6/1988 | Greenlee et al. | |
| 5,566,762 | A | 10/1996 | Braddick et al. | |
| 6,062,309 | A | 5/2000 | Gosse | |
| 6,142,230 | A | 11/2000 | Smalley et al. | |
| 6,325,148 | B1 * | 12/2001 | Trahan | E21B 23/00 166/297 |
| 6,854,521 | B2 | 2/2005 | Echols et al. | |
| 7,090,037 | B2 | 8/2006 | Best | |
| 7,597,140 | B2 | 10/2009 | Filippov et al. | |
| 7,708,063 | B2 | 5/2010 | Palmer | |
| 7,992,644 | B2 | 8/2011 | Giroux | |
| 8,051,913 | B2 | 11/2011 | Huang et al. | |
| 8,251,161 | B2 | 8/2012 | Dithmar et al. | |
| 8,899,336 | B2 | 12/2014 | Giroux et al. | |
| 9,004,184 | B2 | 4/2015 | Di Crescenzo et al. | |
| 2003/0205386 | A1 | 11/2003 | Johnston et al. | |
| 2003/0217844 | A1 | 11/2003 | Moyes | |
| 2004/0231860 | A1 | 11/2004 | Whanger et al. | |
| 2005/0194151 | A1 * | 9/2005 | Dewey | E21B 23/01 166/382 |
| 2007/0068671 | A1 | 3/2007 | Lohbeck | |
| 2008/0156499 | A1 | 7/2008 | Giroux et al. | |
| 2008/0185137 | A1 | 8/2008 | Palmer | |
| 2009/0065196 | A1 | 3/2009 | Holland et al. | |
| 2009/0145666 | A1 | 6/2009 | Radford et al. | |
| 2009/0205840 | A1 | 8/2009 | O'Connor et al. | |
| 2009/0294118 | A1 | 12/2009 | Clemens | |
| 2010/0090410 | A1 | 4/2010 | Doane et al. | |
| 2010/0270035 | A1 | 10/2010 | Ring et al. | |
| 2012/0160480 | A1 | 6/2012 | Wubben et al. | |
| 2012/0273237 | A1 | 11/2012 | Giroux et al. | |
| 2013/0312954 | A1 | 11/2013 | Di Crescenzo et al. | |
| 2015/0247388 | A1 | 9/2015 | Di Crescenzo et al. | |

FOREIGN PATENT DOCUMENTS

| | | | |
|---|---|---|---|
| CN | 101614114 | A | 12/2009 |
| CN | 101720378 | A | 6/2010 |
| EP | 2119867 | A2 | 11/2009 |
| GB | 2361727 | A | 10/2001 |
| GB | 2386626 | A | 9/2003 |
| GB | 2401127 | A | 11/2004 |
| GB | 2411674 | A | 9/2005 |
| WO | 2011023743 | A2 | 3/2011 |
| WO | 2016091971 | A1 | 6/2016 |
| WO | 2017001460 | A1 | 1/2017 |

OTHER PUBLICATIONS

International Search Report and Written Opinion received for PCT Patent Application No. PCT/EP2016/065113 dated Sep. 14, 2016, 09 pages.

International Search Report and Written Opinion received for PCT Patent Application No. PCT/EP2012/051461 dated Mar. 6, 2012, 09 pages.

International Search Report and Written Opinion received for PCT Patent Application No. PCT/EP2013/069107 dated Mar. 13, 2014, 08 pages.

* cited by examiner

RETRIEVABLE SELF-ENERGIZING TOP ANCHOR TOOL

CROSS REFERENCE TO RELATED APPLICATIONS

This is a National stage application of International Application No. PCT/EP2017/083443, filed Dec. 19, 2017, which claims priority benefit of European Application No. 16206380.4, filed Dec. 22, 2016.

FIELD OF THE INVENTION

The present invention relates to a self-energizing top anchor tool that is retrievable from a borehole on a conveyance string.

BACKGROUND TO THE INVENTION

In the oil and gas industry, a wellbore is typically formed by drilling a borehole in the earth, using a drill bit disposed at a downhole end of a drill string that is urged downwardly into the earth. After drilling a so-called open hole section to a predetermined depth, or when circumstances dictate, the drill string and bit are removed and the borehole is lined with a string of casing. The drilling operation is typically performed in stages and a number of strings of casing or liner may be run into the wellbore until the wellbore is at the desired depth and location.

In the past years, a novel technology has become available wherein well tubulars, such as casing, liner or clad tubes are radially expanded against a pre-set host casing set in the borehole. US patent application publication No. 2015/0247388 describes a top anchor tool comprising:

a work string comprising a release sub;

a ramp body having one or more ramp surfaces;

one or more anchor segments each having one or more wedge surfaces corresponding to and engaging the ramp surfaces of the ramp body, and each having an outward facing engagement surface for engaging a pre-installed host casing;

one or more spring members provided to pre-load a respective anchor segment with respect to its corresponding ramp body;

a pusher ring enclosing the work string and engaging the anchor segments at an upper end thereof;

a release ring enclosing the work string and arranged at an opposite end of the segments such that the anchor segments are shut in between the pusher ring and the release ring;

a release sub stop arranged to engage the release ring with the release sub upon receiving the release sub in upward movement against the release sub stop.

To activate the anchor tool of US 2015/0247388, the pusher ring is induced to slide along the work string under influence of a downward force, causing a downward movement of the anchor segments relative to the ramp surfaces upon which the anchor segments move radially outward towards the casing. The engagement surface of each segment, which are suitably provided with engagement teeth, will engage the casing. Springs also push the segments radially outward. A well tubular can be forced upward, for instance by pulling an expansion cone mounted at a distal end of the work string against or through the well tubular in an uphole direction, until the well tubular engages with its top rim against the top anchor tool. The upward load is transmitted from the well tubular to the ramp body, thereby further energizing the anchor segments into their engagement with the casing.

When the release sub reaches the top anchor, the release sub engages the release ring and push the release ring in the uphole direction. As the anchor segments are enclosed between the pusher ring and the release ring, the anchor segments will be caused to slide radially inward along the ramp surfaces, releasing the casing inner surface. The top anchor tool can then be retrieved from the borehole by carrying it out on the work string.

It has been found that at least in some occasions the outer engagement surface of the anchor segments have worn extensively.

SUMMARY OF THE INVENTION

In accordance with a first aspect of the present invention, there is provided a retrievable self-energizing top anchor tool for releasably locking a tubular in place in a previously installed host casing, comprising:

a central energizing mandrel disposed around a longitudinal tool axis, comprising a set of inclined surfaces distributed around a circumference about the longitudinal tool axis and facing away from the tool axis, said central energizing mandrel having a lower end, and an upper end which upper end is separated from the lower end in an upward direction along the longitudinal tool axis;

a set of anchor segments distributed around a circumference of the central energizing mandrel, each having one or more wedge surfaces facing toward the tool axis and corresponding to and engaging the inclined surfaces of the central energizing mandrel, whereby an upward directed movement of the central energizing mandrel along the longitudinal axis relative to the set of anchor segments causes a radially outward movement of the set of anchor segments and whereby a downward movement of the central energizing mandrel along the longitudinal axis relative to the set of anchor segments causes a radially inward movement of the set of anchor segments;

a central longitudinal tool bore for engaging a tool conveyance string extending in the longitudinal direction whereby the tool conveyance string is movable through the central longitudinal tool bore in longitudinal direction; and a release mechanism, comprising a lift mechanism comprising a lift device interacting with the set of anchor segments and a release sub stop, arranged within the central tool bore for engaging a release sub provided on the tool conveyance string, which release sub stop is in mechanical communication with the lift device to transmit an upwardly directed longitudinal force from the release sub to the set of anchor segments via the lift device, said release mechanism further comprising one or more pre-loaded release spring members locked with a release locking mechanism, which, when the release locking mechanism is unlocked exert a retracting bias force on the central energizing mandrel in downward direction along the longitudinal axis relative to the set of anchor segments.

BRIEF DESCRIPTION OF THE DRAWINGS

The invention will be further illustrated hereinafter by way of example only, and with reference to the non-limiting drawing in which.

The person skilled in the art will readily understand that, while the invention is illustrated making reference to one or more a specific combinations of features and measures, many of those features and measures are functionally independent from other features and measures, such that they can be equally or similarly applied independently in other embodiments or combinations.

DETAILED DESCRIPTION OF THE INVENTION

A self-energizing top anchor tool is herein proposed, which is releasable by relative upward movement of a release sub against a release sub stop arranged within the central tool bore, and which has a release mechanism that comprises one or more pre-loaded release spring members locked with a release locking mechanism, which, when the release locking mechanism is unlocked exert a retracting bias force on the central energizing mandrel in downward direction along the longitudinal axis relative to the set of anchor segments.

This downward force on the central energizing mandrel causes a radially inward movement of the set of anchor segments. This force counteracts other forces that may cause the anchor segments to partially or fully deploy, for instance during the retrieval of the tool from the borehole, and therefore this force contributes to keeping the anchor segments to be retracted. Consequently, the outer engagement surfaces of the anchor segments are less exposed to wear and tear during retrieval.

Before unlocking the release locking mechanism, the release spring members may preferably be disengaged from exerting force between the central energizing mandrel and the set of anchor segments, in order not to cause obstruction or hindrance to moving the anchor segments outward during activating and/or energizing of the anchor tool as a result of exerting any release force prematurely.

The release spring members are particularly useful if the tool is provided with one or more energizing spring members exerting an energizing bias force on the central energizing mandrel in downward direction along the longitudinal axis relative to the set of anchor segments. In such a case the release spring members may at least partially, preferably fully, offset the energizing bias force exerted by the energizing spring members. Suitably, the retracting bias force exceeds the energizing bias force.

Figure 1:
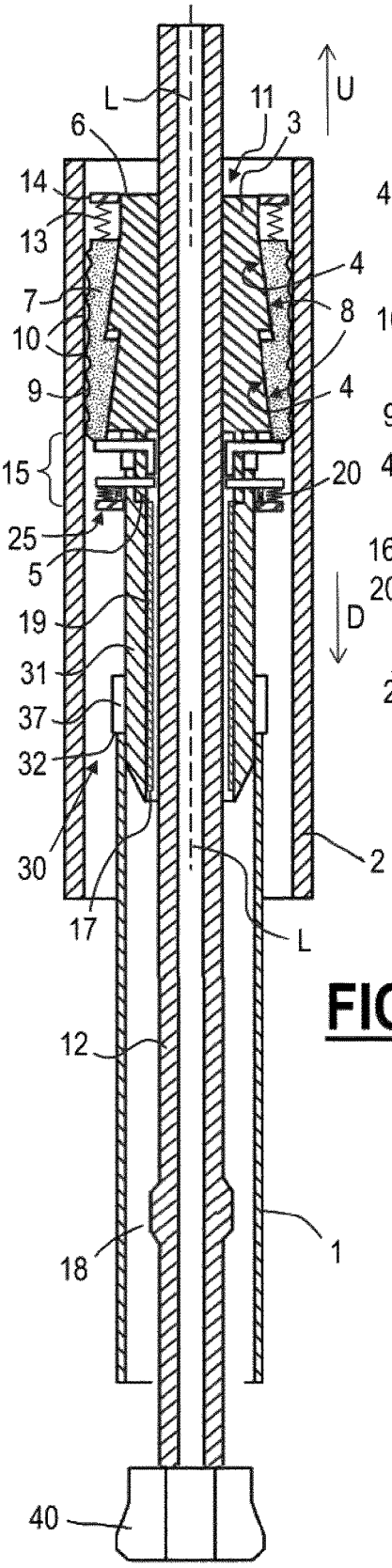
FIG. 1 schematically shows a cross section of a self-energizing top anchor tool deployed on a tool conveyance string.

FIG. 1 shows schematically a cross section of a retrievable self-energizing top anchor tool. The tool can be used for releasably locking a tubular 1 in place in a previously installed host casing 2. The tubular 1 may a casing, a liner, or a clad tube. For ease of reference, the tubular 1 will hereinbelow be referred to as "liner 1" without intending any limitation. Suitably, at least a top end of the tubular 1 is inserted in, and has overlap with, the host casing 2. The tool is built up around a central longitudinal tool bore 11, for engaging a tool conveyance string 12 extending in a longitudinal direction. The tool conveyance string 12 is movable upward and downward through the central longitudinal tool bore 11, in longitudinal direction.

Figure 2:
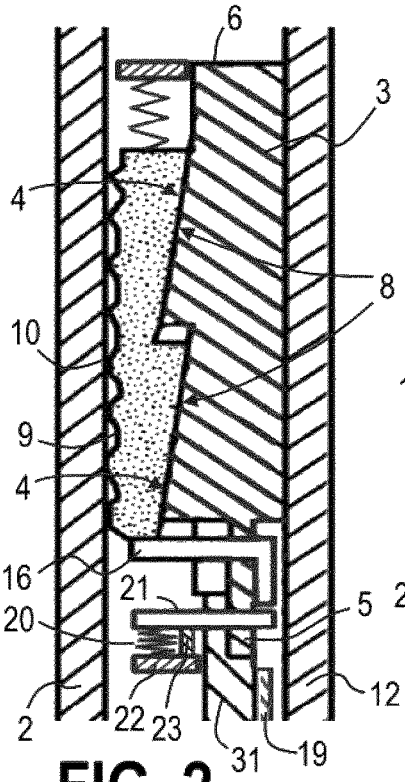
FIG. 2 schematically shows an enlarged view of parts of the self-energizing top anchor tool of FIG. 1 around the central energizing mandrel thereof.

Referring now to both FIGS. 1 and 2, a central energizing mandrel 3 is disposed around a longitudinal tool axis L. The longitudinal tool axis L is centered in the central longitudinal tool bore 11. The central energizing mandrel 3 has a set of inclined surfaces 4 distributed around a circumference about the longitudinal tool axis L, and facing away from the tool axis L. The central energizing mandrel 3 has a lower end 5 and an upper end 6. The upper end 6 is separated from the lower end 5 in an upward direction U along the longitudinal tool axis L.

A set of anchor segments 7 is arranged, the anchor segments 7 being distributed around a circumference of the central energizing mandrel 3. Each of the anchor segments 7 has one or more wedge surfaces 8 facing toward the tool axis L and corresponding to and engaging the inclined surfaces 4 of the central energizing mandrel 3. As a result of the interaction of these surfaces, an upward directed movement U of the central energizing mandrel 3 along the longitudinal axis L relative to the set of anchor segments 7 causes a radially outward movement of the set of anchor segments 7. Conversely, a downward movement D of the central energizing mandrel 3 along the longitudinal axis L relative to the set of anchor segments 7 causes a radially inward movement of the set of anchor segments 7. The anchor segments 7 comprise an outer facing engagement surface 9, configured to engage the inside wall of the host casing 2.

Suitably, the anchor segments 7 are slidingly engaging the inclined surfaces 4 of the central energizing mandrel 3, whereby only relative movement parallel to the corresponding inclined surface is possible. The wedge surfaces 8 of the anchor segments 7 may, for instance, be provided with a dovetail shaped ridge, fitting into a correspondingly shaped guide channel of the corresponding inclined surface 4 on the central energizing mandrel 3, and together forming a sliding dovetail joint. Alternatively, the guide channel may be provided in the anchor segments 7 and the dovetail on the central energizing mandrel 3. The outer facing engagement surface 9 of the anchor segments 7, facing the host casing 2, may be provided with teeth 10 to enhance gripping with the host casing 2.

At its lower end 5, the central energizing mandrel 3 is connected to a force transmission sub 30. The force transmission sub may comprise a tubular body 31 circumferencing the central tool bore 11. The tubular force transmission body 31 extends away from the upper end 6. Suitably, this tubular force transmission body 31 is a separate element fixed to the central energizing mandrel 3. However, it may also form an integral part of the central energizing mandrel 3. A tube stop 32 is provided on a lower end of the tubular force transmission body 31. The liner 1 can engage with the tube stop 32, and when pushed against the tube stop 32 the upward directed force of the liner against the tube stop is transmitted to the central energizing mandrel 3 translating in an upward movement of the central energizing mandrel 3 relative to the anchor segments 7. Thus the larger the upward directed force, the more the top anchor tool is energized and the stronger is the grip on the host casing 2. The tube stop 32 may be permanently connected to the tubular force transmission body 31 or form an integral part thereof. However, in certain advantageous embodiments, the tube stop 32 is locked to the tubular force transmission body 31 by means of, for instance, a tube stop lock mechanism 35. This will be described more extensively elsewhere in this description.

Still referring to FIGS. 1 and 2, the self-energizing top anchor tool is optionally provided with one or more energizing spring members 13, which can exert an energizing bias force on the central energizing mandrel 3 in downward direction D along the longitudinal axis L relative to the set of anchor segments 7. In this example the energizing spring members 13 are shown to engage with the central energizing mandrel 3 via a sleeve 14 that is axially fixed to the central energizing mandrel 3, and with the anchor segments at a top end thereof. However, there are many alternative embodiments that achieve similar effects, including the embodiment shown in US publication No. 2015/0247388.

The self-energizing top anchor tool further is provided with a release mechanism. One embodiment of the release mechanism comprises a lift mechanism 15. The lift mechanism 15 comprises a lift device 16, which interacts with the set of anchor segments 7. The lift device 16 may suitably be embodied in the form of an axially slidable sleeve or ring that can engage with the anchor segments 7 and push them in upward direction. The lift device 16 also interacts with a release sub stop 17.

Figure 3:
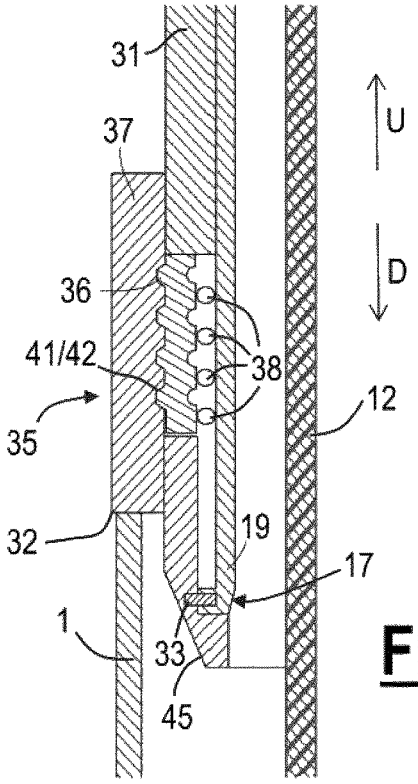
FIG. 3 schematically shows an enlarged view of parts of a force transmission sub of the self-energizing top anchor tool of FIG. 1.

The release sub stop 17 is also depicted in FIG. 3 in an enlarged view. The release sub stop 17 is arranged within the central tool bore 11, for engaging a release sub 18 provided on the tool conveyance string 12. The release sub stop 17 may be located on a lower end of a distance holder 19 that may suitably be arranged axially slidably within the central tool bore 11. Suitably, distance holder 19 may be embodied in the form of an inner sleeve. Its function is to establish mechanical communication with the lift device 16, to transmit an upwardly directed longitudinal force from the release sub 18 to the set of anchor segments 7, via the lift device 16. One or more distance holder break members 33, or similar functional latching mechanisms, are provided to secure the distance holder 19 in longitudinal direction with the force transmission body 31. These distance holder break members 33 fail (or the mechanism unlatches otherwise) upon exposure to a second break force exceeding a second threshold value.

The release sub 18 may include a ridge having an increased outer diameter relative to the tool conveyance string 12. The ridge, which may be chamfered, may act as a lift shoulder as will be described below.

The release mechanism is further provided with one or more release spring members 20. Prior to being unlocked, the release spring members 20 are locked in a pre-loaded condition by means of a release locking mechanism 25. The function of the release locking mechanism 25 is to keep the release spring members 20 in pre-loaded condition and disengaged from exerting any force between the central energizing mandrel 3 and the set of anchor segments 7. Unlocking of the release locking mechanism 25 is triggered by an upward movement along the longitudinal tool axis L of the release sub stop 17 relative to the release locking mechanism 25. To this end, release locking mechanism 25 may be in mechanical communication with the release sub stop 17, suitably via the distance holder 19.

The release locking mechanism 25 can be embodied in a multitude of ways. In the shown example, the release locking mechanism 25 is schematically depicted by a locking ring 21 and a counter ring 22, held together by a release lock break member 23, whereby the release spring members 20 are sandwiched between the locking ring 21 and the counter ring 22. In this embodiment, the counter ring 22 is axially fixed with the lower end 5 of the central energizing mandrel 3. Failure of the release lock break members 23, upon a first break force exceeding a first threshold value, causes the release locking mechanism 25 to be unlocked. When the release locking mechanism 25 is unlocked, the locking ring 21 may slide upward under force exerted by the release spring members 20 and exert a reacting retracting bias force on the central energizing mandrel 3 in downward direction along the longitudinal axis, relative to the set of anchor segments 7.

Figure 4:
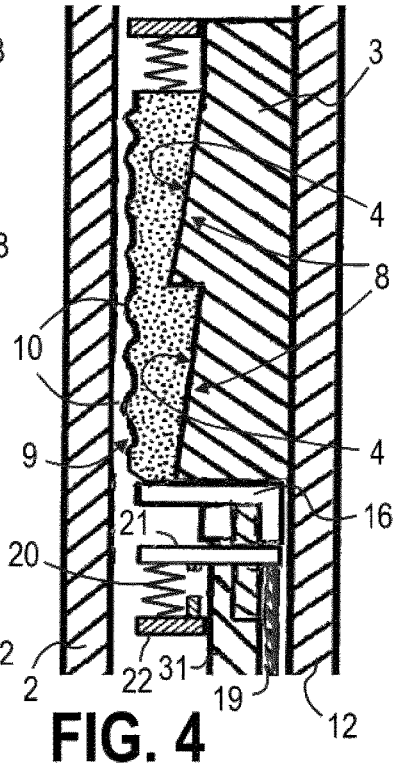
FIG. 4 schematically shows the enlarged view of FIG. 2 after unlocking the release locking mechanism the self-energizing top anchor tool.

Suitably, the release locking mechanism 25 is in mechanical communication with the release sub stop 17, whereby the first break force is transmitted from the release sub stop 17 to the release lock break members 23 via the distance holder 19. This is illustrated in FIGS. 4 to 6.

Figure 5:
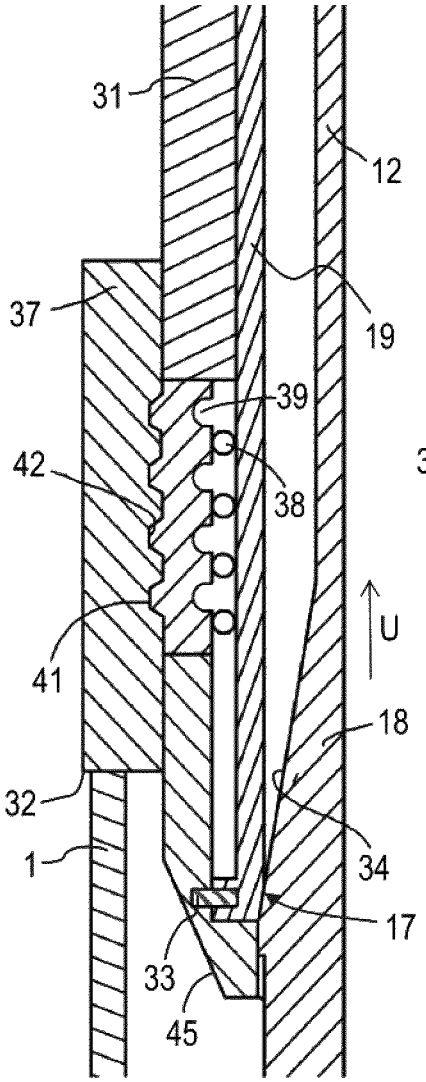
FIGS. 5 and 6 schematically show successive stages leading to unlocking of the release locking mechanism the self-energizing top anchor tool.
Figure 6:
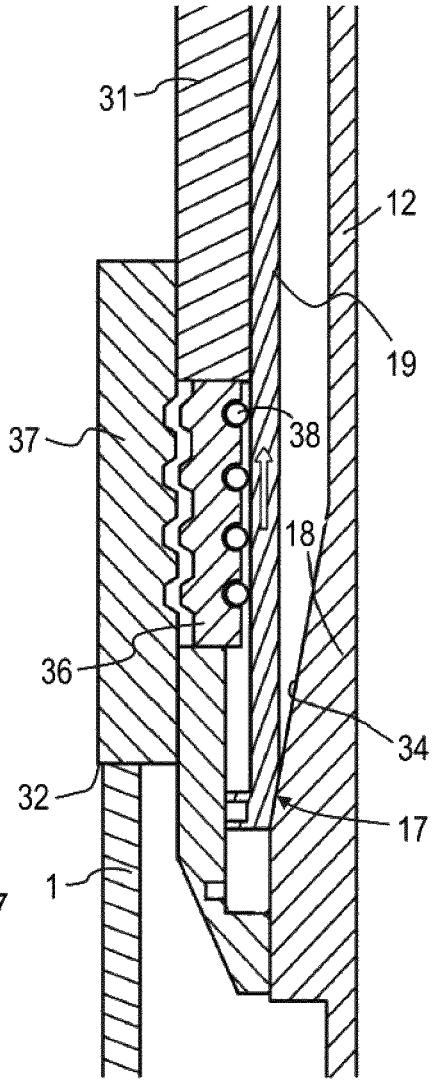

As shown in FIGS. 5 and 6, if the release sub stop 17 is moved upward then the distance holder 19 moves upward. Upward movement of the distance holder 19 may be driven by engaging the lift shoulder 34 of the release sub 18, which is provided on the tool conveyance string 12, against the release sub stop 17 as illustrated in FIG. 5. FIG. 6 illustrates how further pulling of the tool conveyance string 12 in upward direction U may result in corresponding upward movement of the distance holder 19. As best illustrated in FIG. 4, as a result of the movement, the upper end of the distance holder 19 engages with the locking ring 21 and this way the first break force is applied to the release lock break members 21. When these have failed, upon the first break force exceeding the first threshold value, the release locking mechanism 25 is unlocked and the release spring members 20 exert their retracting bias force on the central energizing mandrel 3 in downward direction along the longitudinal axis L relative to the set of anchor segments 7. Suitably, the retracting bias force between the set of anchor segments 7 and the central energizing mandrel 3 is applied via the lift device 16 which lift the anchor segments 7 relative to the central energizing mandrel 3. The remainder of the release force is delivered through interaction of the distance holder 19 against the lift device 16. However, if the retracting bias force exceeds the energizing bias force the self-energizing top anchor tool is self-releasing regardless of the force that is delivered through the interaction of the distance holder 19 against the lift device 16. As a result, the anchor segments 7 will remain in retracted position after unlocking of the release locking mechanism 25.

The self-energizing top anchor tool may then be lifted out of the borehole by pulling the tool conveyance string 12 out of the borehole. The self-energizing top anchor tool is then carried on the lift shoulder 34 of release sub 18.

Suitably, protective shoulders are provided on the tool, with an outer shoulder circumference. In the schematic illustration of FIG. 1, sleeve 14 may function as such protective shoulder. However, the protective shoulders may also be implemented in separate tool parts. The outer shoulder circumference is advantageously sized such that the outward facing engagement surfaces 9 of the anchor segments 7 radially extend beyond the outer shoulder circumference in a tool activated condition, while in tool retracted condition the outward facing engagement surfaces 9 of the anchor segments 7 is retracted to within the outer shoulder circumference. Suitably, the tool retracted condition is achieved when the retracting bias force is exerted on the central energizing mandrel 3 as described above. This way the outward facing engagement surfaces 9 of the anchor segments 7 are protected against wear and tear when pulling the out of the borehole.

The self-energizing top anchor tool is primarily intended to cooperate with an expander 40, which may suitably be attached at a distal end of the tool conveyance string 12 below the liner 1 that is to be expanded. The expander 40 is pulled through the liner 1, which is thereby forced upward against the tube stop 32. As described above, this force contributes to the energizing of the top anchor tool, which helps to secure the liner 1 in stages of the expansion operation. However, due to axial strain that builds up in the liner 1 during the expansion operation, the liner 1 may continue to contribute to the energizing of the top anchor tool when the release sub 18 engages with the release sub stop 17.

To facilitate the release of the top anchor tool, tube stop lock mechanism 35 is provided. At first, the tube stop 32 is longitudinally locked to the tubular force transmission body 31 with the tube stop lock mechanism 35, to prevent the tube stop 32 from moving upward relative to the force transmission body 31. Thus, with the tube stop lock mechanism 35 in locked condition, the upward directed force of liner 1 pressed against the tube stop 32 is transmitted via the force transmission sub 30 to the central energizing mandrel 3. Upon unlocking of the tube stop lock mechanism 35, the tube stop 32 is released to move at least in upward direction relative to force transmission body 31, as result of which the upward force transmission from the liner 1 to the body 31 is decoupled.

A suitable embodiment of the tube stop lock mechanism 35, and its operation, is illustrated in FIGS. 3, 5, and 6. In this embodiment, the tube stop 32 is a camfer or ridge on an outer sleeve 37 which arranged on the tubular force transmission body 31 of the force transmission sub 30. The outer sleeve 37 is capable of sliding longitudinally upward such that axial strain in the liner 1 can be relieved. The tube stop locking mechanism 35 suitably locks the tube stop 32 by locking the outer sleeve 37.

Regardless of the precise implementation of the tube stop 17 in the tool, the tube stop lock mechanism 35 is preferably in mechanical communication with the release sub stop 17, such that an upward movement along the longitudinal tool axis L of the release sub stop 17 relative to the tube stop lock mechanism 35 triggers the unlocking of the tube stop lock mechanism 35. The axial decoupling of the liner 1 and the unlocking of the release locking mechanism 25 may, as a result, be inherently concerted actions. The distance holder break members 33 avoid premature unlocking and/or to keep the distance holder 19 in place before unlocking.

The axial force imposed via the liner 1 on the tubular force transmission body 31 can be significant, which may pose specific mechanical requirements on the tube stop lock mechanism 35. The embodiment shown in FIGS. 3, 5, 6 is one suitable example. It makes use of a number of collets 36 distributed around the inner circumference of the outer sleeve 37, and each locked in place by a set of rollers 38 which engage with the cylindrical outward facing surface of the distance holder 19 which prohibits radially inward movement of the collet 36. The outward facing surface of the collet is provided with a pattern of number of outward protruding ridges 41, which fall into a corresponding inverse pattern of recesses 42 provided in the cylindrical inward facing surface of the outer sleeve 37. The inward facing surface of the collet is provided with a number of receptacle recesses 39, spaced to receive the set of rollers 38. The set of rollers 38 can roll to the receptacle recesses 39 and when the rollers 38 are caught in these receptacle recesses 39 the collets 36 can move radially inward and thereby release the outer sleeve 37. The tube stop lock mechanism 35 is thus unlocked by action of the upward movement of the distance holder 19 relative to the tubular force transmission body 31.

In initial condition, i.e. prior to the release sub 18 contacting the release sub stop 17 and/or with the distance holder break members 33 intact, the longitudinal distance between the top of the distance holder 19 and the lift mechanism 15 is longer than a longitudinal unlocking stroke distance needed to unlock the tube stop lock mechanism 35 by the upward movement of the distance holder 19. This ensures that the tube stop lock mechanism 35 is always unlocked before the anchor segments 7 are lifted.

FIG. 5 shows release sub 18 contacts the release sub stop 17, but cannot pass through it. FIG. 6 shows that in the force applied by the release sub 18 causes upward movement of the distance holder 19 with the release sub 18. As a result of the movement of the distance holder 19 the sets of rollers 38 start rolling until they reach the receptacle recesses 39 and thereby unlock the collets 36 so that the outer sleeve 37 is released and can slide over the tubular force transmission body 31. The stroke of the outer sleeve 37 is sufficient to allow any axial strain developed in the liner 1 to be released.

Upon further upward movement, the distance holder 19 contacts the lifting mechanism 15 and/or the release lock mechanism 25. After some further movement, the central energizing mandrel 3 no longer transmits load to the anchor segments 7, so that the latter can be lifted by the distance holder 19 assisted by the retracting bias force. Subsequently the self-energizing top anchor tool is carried out of the hole by the release sub 18 via the distance holder.

Figure 7:
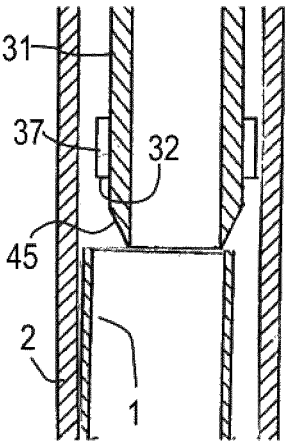
FIG. 7 schematically illustrates the function of the guide nose provided on the self-energizing top anchor tool of FIG. 1.

As best illustrated in FIG. 7, the tubular force transmission body 31 may suitably be provided with an inwardly tapered lower end, which forms a guide nose 45. For instance, the outer diameter of the lower end of the tubular body 31 (seen in cross section) is gradually decreasing when considered in points going downward in longitudinal direction. This guide nose 45 is designed such that the tip of the guide nose 45 (which has the smallest outer diameter) will enter into the top of the liner 1 when these two approach each other, even when the liner 1 is sliding on one side of the host casing 2 while the self-energizing top anchor tool is on a diametrically opposing side of the host casing 2. The smallest outer diameter of the guide nose 45 can easily be calculated for any given inner diameter of the host casing 2 and of the liner 1, depending on the tool geometry. With such a guide nose 45, even if there is an longitudinal separation of the self-energizing top anchor tool from the liner 1, the liner 1 will find the tube stop 32. This eliminates the need for a long wash tube (as for example shown in FIG. 1 of International application No. PCT/EP2016/065113) permanently extending slidably into the top of the liner 1, while still allowing for mechanical and thermal elongation and shortening of the liner 1 during assembly and running into the borehole.

It is conceived that the tube stop lock mechanism 35 and/or the guide nose 45, each described herein, can be applied to other self-energizing top anchor tool designs, including designs that do not employ a release locking mechanism and/or release spring members. Examples of such designs are provided in, for instance, US pre-grant publication No. 2015/0247388 and U.S. Pat. No. 8,899,336.

The precise design and implementation of the various parts and functionalities of the tool, and of the release locking mechanism 25 as shown herein are not limiting on the disclosure. The person skilled in the art will agree that all sorts of solutions are available in mechanical engineering practices that are capable of carrying out the basic functionality of the release locking mechanism 25 as described herein. For example, the functionality of the release lock break members 23 may be provided by a collet and/or latch mechanism that is pushed aside and/or unlatched by action of the distance holder 19.

The tool conveyance string 12 may further be provided with an on/off sub (not shown) which allows the expander 40 (or other tool) to be connected to and/or disconnected from the tool conveyance string 12 if required. The on/off sub is suitably arranged between the release sub 18 and the expander 40, so that after disconnecting the expander 40 the self-energizing top anchor tool still can be lifted out of the borehole by means of the release sub 18.

It is further remarked that the spring members in the drawings, schematically represented by zig-zag lines, can be embodied in many forms without limitation. Possibilities include mechanical springs, spring disks, resilient elastic materials such as flexible rubber blocks, and hydraulic or pneumatic springs, and combinations of two or more options.

Various parts and features of the tool described herein have been described in detail in US pre-grant publication No. 2015/0247388 A1, which is incorporated herein by reference. Also, the contents of US pre-grant publication No. 2013/0312954 A1 and of International application No. PCT/EP2016/065113 are incorporated herein by reference.

The terms "upper", "lower", "upward", and "downward" are intended to identify two distinct ends of the SETA tool on its longitudinal tool axis and longitudinal directions relative to these two ends. The terms are not intended to imply any direction compared to gravity. However, certain embodiments of the SETA tool disclosed herein are intended to be inserted into the borehole with the upper end trailing the lower end.

The person skilled in the art will understand that the present invention can be carried out in many various ways without departing from the scope of the appended claims.

That which is claimed is:

1. A retrievable self-energizing top anchor tool for releasably locking a tubular in place in a previously installed host casing, comprising:

a central energizing mandrel disposed around a longitudinal tool axis, comprising a set of inclined surfaces distributed around a circumference about the longitudinal tool axis and facing away from the tool axis, said central energizing mandrel having a lower end, and an upper end which upper end is separated from the lower end in an upward direction along the longitudinal tool axis;

a set of anchor segments distributed around a circumference of the central energizing mandrel, each having one or more wedge surfaces facing toward the tool axis and corresponding to and engaging the inclined surfaces of the central energizing mandrel, whereby an upward directed movement of the central energizing mandrel along the longitudinal axis relative to the set of anchor segments causes a radially outward movement of the set of anchor segments and whereby a downward movement of the central energizing mandrel along the longitudinal axis relative to the set of anchor segments causes a radially inward movement of the set of anchor segments;

a central longitudinal tool bore for engaging a tool conveyance string extending in the longitudinal direction whereby the tool conveyance string is movable through the central longitudinal tool bore in longitudinal direction; and a release mechanism, comprising a lift mechanism comprising a lift device interacting with the set of anchor segments and a release sub stop, arranged within the central tool bore for engaging a release sub provided on the tool conveyance string, which release sub stop is in mechanical communication with the lift device to transmit an upwardly directed longitudinal force from the release sub to the set of anchor segments via the lift device, said release mechanism further comprising one or more pre-loaded release spring members locked with a release locking mechanism, which, when the release locking mechanism is unlocked exert a retracting bias force on the central energizing mandrel in downward direction along the longitudinal axis relative to the set of anchor segments.

2. The tool of claim 1, wherein before unlocking the release locking mechanism the release spring members are disengaged from exerting force between the central energizing mandrel and the set of anchor segments.

3. The tool of claim 1, further comprising:

one or more energizing spring members exerting an energizing bias force on the central energizing mandrel in downward direction along the longitudinal axis relative to the set of anchor segments.

4. The tool of claim 3, wherein the retracting bias force exceeds the energizing bias force.

5. The tool of claim 1, wherein the release locking mechanism is in mechanical communication with the release sub stop, whereby an upward movement along the longitudinal tool axis of the release sub stop relative to the release locking mechanism triggers unlocking of the release locking mechanism.

6. The tool of claim 1, wherein the release locking mechanism comprises one or more release lock break members and wherein release locking mechanism is in mechanical communication with the release sub stop to transmit a first break force to the release lock break members, and wherein failure of the release lock break members upon the first break force exceeding a first threshold value causes the release locking mechanism to be unlocked.

7. The tool of claim 1, further comprising one or more protective shoulders having an outer shoulder circumference, wherein the anchor segments each comprise an outward facing engagement surface which radially extends beyond the outer shoulder circumference in an activated condition and which is retracted to within the outer shoulder circumference when the retracting bias force is exerted on the central energizing mandrel.

8. The tool of claim 1, wherein the central energizing mandrel at the lower end thereof comprises a force transmission sub comprising a tubular force transmission body circumferencing the central tool bore and extending away from the upper end, wherein a tube stop is provided on the tubular force transmission body whereby an upward directed force of a tubular pressed against the tube stop is transmitted to the central energizing mandrel.

9. The tool of claim 8, wherein the tube stop is longitudinally locked to the tubular force transmission body with a tube stop lock mechanism preventing movement of the tube stop relative to the force transmission body in the longitudinal direction, whereby an upward directed force imposed by a tubular pressed against the tube stop is transmitted via the lock mechanism to the force transmission sub to the central energizing mandrel, whereby the tube stop lock mechanism can be unlocked so that the tube stop is released to move in longitudinal direction relative to the tubular force transmission body.

10. The tool of claim 9, wherein the tube stop lock mechanism is in mechanical communication with the release sub stop, whereby an upward movement along the longitudinal tool axis of the release sub stop relative to the tube stop lock mechanism triggers unlocking of the tube stop lock mechanism.

11. The tool of claim 10, wherein the force transmission sub comprises a distance holder extending between the release sub stop and the release locking mechanism, which distance holder is longitudinally slidable in upward direction relative to the tubular force transmission body, and wherein the release sub stop and mechanically communicates with the release locking mechanism by means of the distance holder.

12. The tool of claim 11, further comprising one or more distance holder break members fixing the distance holder in longitudinal direction with the tubular force transmission body, which distance holder break members fail upon exposure to a second break force exceeding a second threshold value.

13. The tool of claim 11, wherein the tube stop forms part of an outer sleeve slidably arranged on the tubular force transmission body in the longitudinal direction whereby the outer sleeve is configured slidable over the tubular force transmission body upwardly in the longitudinal direction.

14. The tool of claim 11, wherein the tube stop lock mechanism is unlocked by action of upward movement of the distance holder relative to the force transmission body.

15. The tool of claim 14, wherein in initial condition the longitudinal distance between the top of the distance holder and the lift mechanism is longer than a longitudinal unlocking stroke distance needed to unlock the tube stop lock mechanism by the upward movement of the distance holder.

* * * * *